US011724875B2

(12) United States Patent
Christian et al.

(10) Patent No.: US 11,724,875 B2
(45) Date of Patent: Aug. 15, 2023

(54) TWO-PART GARBAGE CAN WITH HANDLES ON THE BASE

(71) Applicant: 3 BOYS ENTERPRISES, LLC, Gallatin, TN (US)

(72) Inventors: Jeffrey S. Christian, Gallatin, TN (US); Daniel Birkhead, Gallatin, TN (US)

(73) Assignee: 3 Boys Enterprises, LLC, Gallatin, TN (US)

( * ) Notice: Subject to any disclaimer, the term of this patent is extended or adjusted under 35 U.S.C. 154(b) by 0 days.

(21) Appl. No.: 18/051,917

(22) Filed: Nov. 2, 2022

(65) Prior Publication Data

US 2023/0227253 A1 Jul. 20, 2023

Related U.S. Application Data

(63) Continuation-in-part of application No. 17/083,812, filed on Oct. 29, 2020, now abandoned, which is a (Continued)

(51) Int. Cl.
*B65F 1/12* (2006.01)
*B65F 1/06* (2006.01)
(Continued)

(52) U.S. Cl.
CPC ..... *B65F 1/125* (2013.01); *B65F 1/068* (2013.01); *B65F 1/1452* (2013.01); *B65F 1/16* (2013.01); *B65F 2230/15* (2013.01)

(58) Field of Classification Search
CPC ..... B65F 1/06; B65F 1/16; B65F 1/12; B65F 1/1452; B65F 1/115; B65F 1/141;
(Continued)

(56) References Cited

U.S. PATENT DOCUMENTS 3,997,072 A 12/1976 Guth
4,643,380 A * 2/1987 Copeland ..... B65F 1/00 141/390
(Continued)

FOREIGN PATENT DOCUMENTS

EP 1580148 A1 9/2005
JP 2003267505 A 9/2003
(Continued)

OTHER PUBLICATIONS

International Search Report issued in International Patent Application No. PCT/US2021/036395 dated Sep. 10, 2021.
(Continued)

*Primary Examiner* — King M Chu
(74) *Attorney, Agent, or Firm* — United IP Counselors, LLC

(57) ABSTRACT

A trash can for the collection and disposal of trash is disclosed. The trash can includes a base and a separable sidewall allowing for easy removal of a bag from the trash can by lifting the sidewall around the bag, rather than lifting the bag through the top of the trash can. The base includes a pair of straps that allow a user to carry it. The sidewall includes recesses that are positioned and adapted to receive the pair of straps when the sidewall rests on the base.

13 Claims, 11 Drawing Sheets

Related U.S. Application Data continuation of application No. 16/898,774, filed on Jun. 11, 2020, now Pat. No. 10,858,181.

(51) Int. Cl.
*B65F 1/16* (2006.01)
*B65F 1/14* (2006.01)

(58) Field of Classification Search
CPC ..... B65F 1/1468; B65F 1/125; B65F 1/068; B65F 2230/15
USPC .... 220/495.06, 908, 495.11, 908.1, 625, 324
See application file for complete search history.

(56) References Cited

U.S. PATENT DOCUMENTS

| | | | | |
|---|---|---|---|---|
| 4,842,228 | A * | 6/1989 | Kasper | B65F 1/1415 220/908 |
| 6,508,377 | B1 | 1/2003 | Griswold et al. | |
| 6,815,036 | B1 | 11/2004 | Romero | |
| 7,500,430 | B2 | 3/2009 | Claflin et al. | |
| 9,815,622 | B2 | 11/2017 | Dafoe | |
| 10,858,181 | B1 | 12/2020 | Christian | |
| 2002/0003144 | A1 | 1/2002 | Grimes | |
| 2003/0209549 | A1* | 11/2003 | Grimes | B65F 1/06 220/495.08 |
| 2010/0282765 | A1 | 11/2010 | Hayes | |
| 2013/0048641 | A1 | 2/2013 | Romano | |

FOREIGN PATENT DOCUMENTS

| | | | |
|---|---|---|---|
| KR | 100966235 | B1 | 6/2010 |
| KR | 200490961 | Y1 | 1/2020 |

OTHER PUBLICATIONS

Joseph Joseph, "Totem Waste & Recycling Trash Can." Internet, https://us.josephjoseph.com/collections/waste-recycling-bins/products/totem-max-and-compact-waste-recycling-bins?variant=31990019915854 (last visited Jun. 11, 2020).

Written Opinion issued in International Patent Application No. PCT/US2021/036395 dated Sep. 10, 2021.

* cited by examiner

TWO-PART GARBAGE CAN WITH HANDLES ON THE BASE

CROSS-REFERENCE TO RELATED APPLICATIONS

This application is a continuation-in-part of U.S. patent application Ser. No. 17/083,812, filed on Oct. 29, 2020, which is a continuation of U.S. application Ser. No. 16/898,774, filed Jun. 11, 2020, now U.S. Pat. No. 10,858,181. The contents of those applications are incorporated by reference herein in their entireties.

TECHNICAL FIELD

This invention relates to trash can assemblies for collecting and disposing of trash.

BACKGROUND

The humble trash can is ubiquitous in modern homes. Meant to store trash temporarily until it can be removed to a larger container for collection, trash cans are used in a variety of sizes throughout the home. While trash cans are made in nearly endless varieties, the typical trash can is essentially a round or rectilinear bucket. A lid may or may not be used to cover the trash can. In many cases, a plastic trash bag, or other type of impermeable liner, is used with the trash can. The trash bag helps to contain liquids and odors and keeps the inside of the trash can at least somewhat cleaner.

The problem with the typical trash can and trash bag is well known: emptying the trash can is often an ordeal. Once the trash bag is full, the user is usually required to lift the bag out of the trash can and carry the bag to another container or location for collection. This is often harder than it sounds—a heavily-loaded trash bag may tear or break during the process, potentially allowing trash to fall out. Even if the trash bag does not tear, removing it from the trash may be more difficult than expected: as trash is placed in the bag and air is forced out of the bottom of the trash can, a partial vacuum can be created between the bag and the trash can, increasing the amount of force it takes to drag the trash bag out of the trash can.

There have been some attempts to lessen the ordeal of emptying a trash can. For example, U.S. Pat. No. 9,815,622 to Dafoe discloses a two-part trash can with a separable bottom and sidewall. This is intended to make it easier to empty the trash can. However, this design has a constriction in the width of the trash can near the base, which reduces the overall volume of the trash can and may cause other problems. Additionally, while this kind of separable-base-and-sidewall design may make it easier to get the trash bag out of the trash can, it does not necessarily make it any easier to move the filled trash bag to another location for collection.

BRIEF SUMMARY

One aspect of the invention relates to a trash can for collection and disposal of trash. The trash can includes a sidewall that is separable from a base of the trash can. This allows for easy removal of a bag from the trash can by lifting the sidewall around the bag, rather than lifting the bag through the top of the trash can.

In another aspect, the sidewall of the trash can tapers outwardly from a top opening to the bottom opening. The tapered shape increases the overall volume of the trash can, thus allowing for more material to be deposited within a trash bag contained in the trash can.

In a further aspect, the sidewall of the trash can form a bottom opening without a constriction in the width of the sidewall. The lack of a constriction at the bottom of the sidewall facilitates sliding the sidewall around a trash bag and other contents within the trash can while the sidewall is separated from the base.

In another aspect, the base of the trash can is connected to straps that include a handle between the straps. The straps hold the sidewall and base together when the handle engages a holder on the sidewall. The handles allow for convenient carrying of the base and other materials thereon.

In another aspect of the invention, the base of the trash can includes a perimeter wall inhibiting a trash bag or other material from escaping the base. The base may also include a support rib that may strengthen the base against buckling or failure.

Yet another aspect of the invention relates to a trash can for collection and disposal of trash. The trash can includes a sidewall that is separable from a base of the trash can. This allows for easy removal of a bag from the trash can by lifting the sidewall around the bag, rather than lifting the bag through the top of the trash can. The base includes a pair of straps that are integral to the base and can be used to carry the base. The sidewall includes recesses that are positioned and adapted to engage the straps when the sidewall rests on the base. The recesses may have a negative shape of the sidewall.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
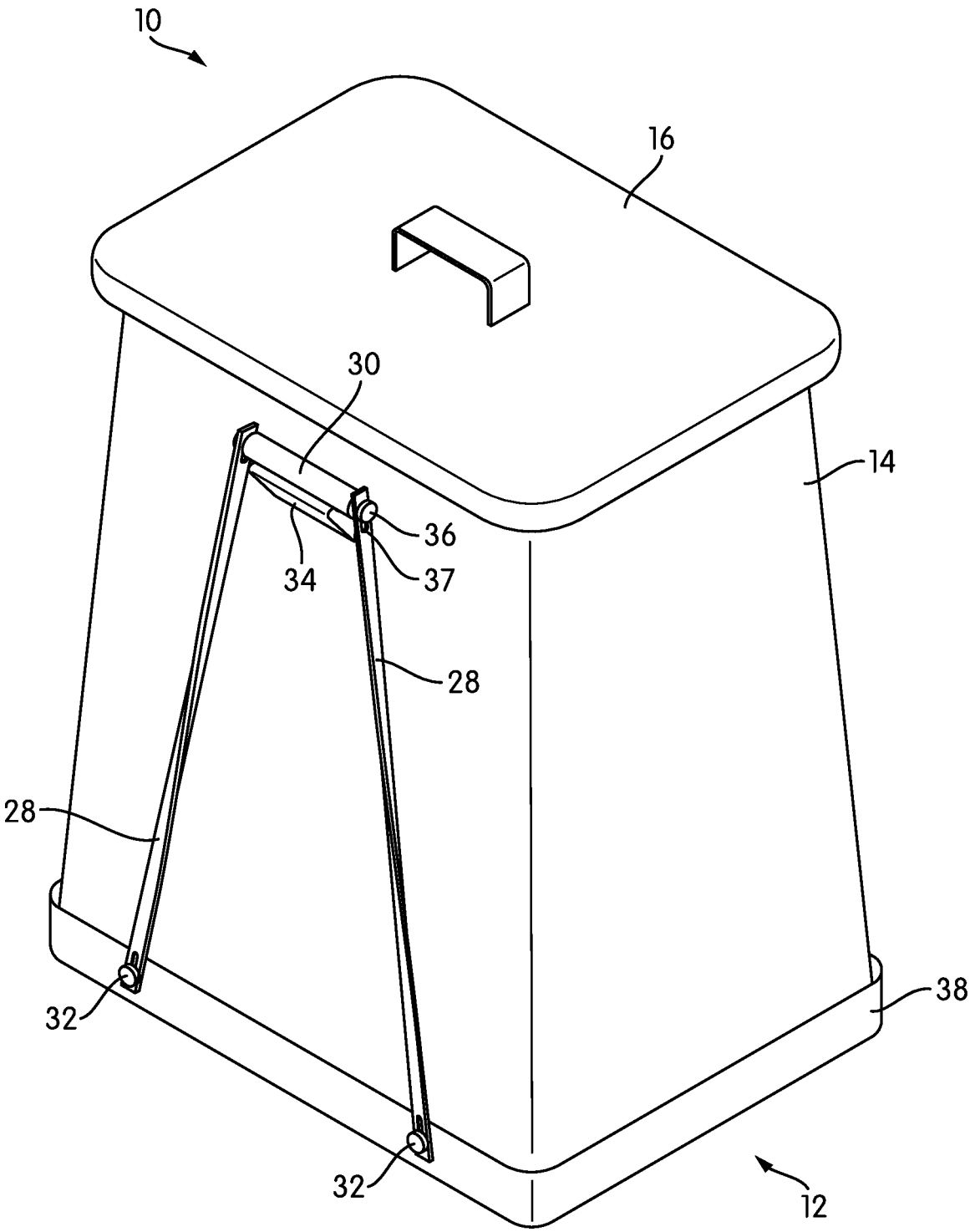
FIG. 1 is a perspective view of a trash can according to an embodiment of the invention.

FIG. 1 is a perspective view of a trash can 10 according to an embodiment of the invention. Trash can 10 includes a base 12 and a sidewall 14. A simple lid 16 tops sidewall 14 and closes trash can 10 in FIG. 1, but other types of lids may be used in other embodiments. In the illustrated embodiment, base 12, sidewall 14, and lid 16 have rectilinear features, although they could be round or rounded in other embodiments. As will be described below in more detail, base 12 and sidewall 14 are separable from one another.

Figure 2:
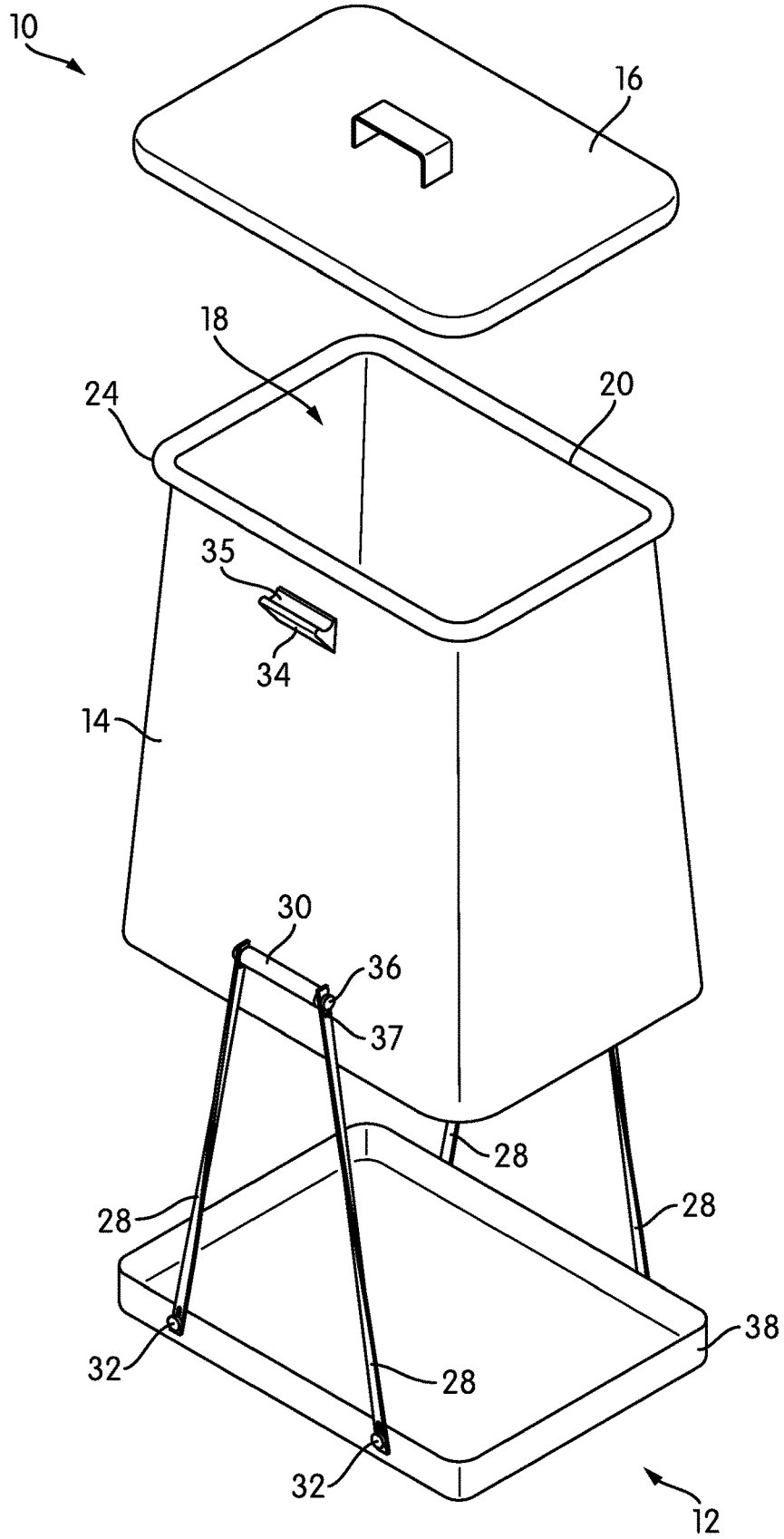
FIG. 2 is an exploded perspective view of the trash can of FIG. 1.
Figure 3:
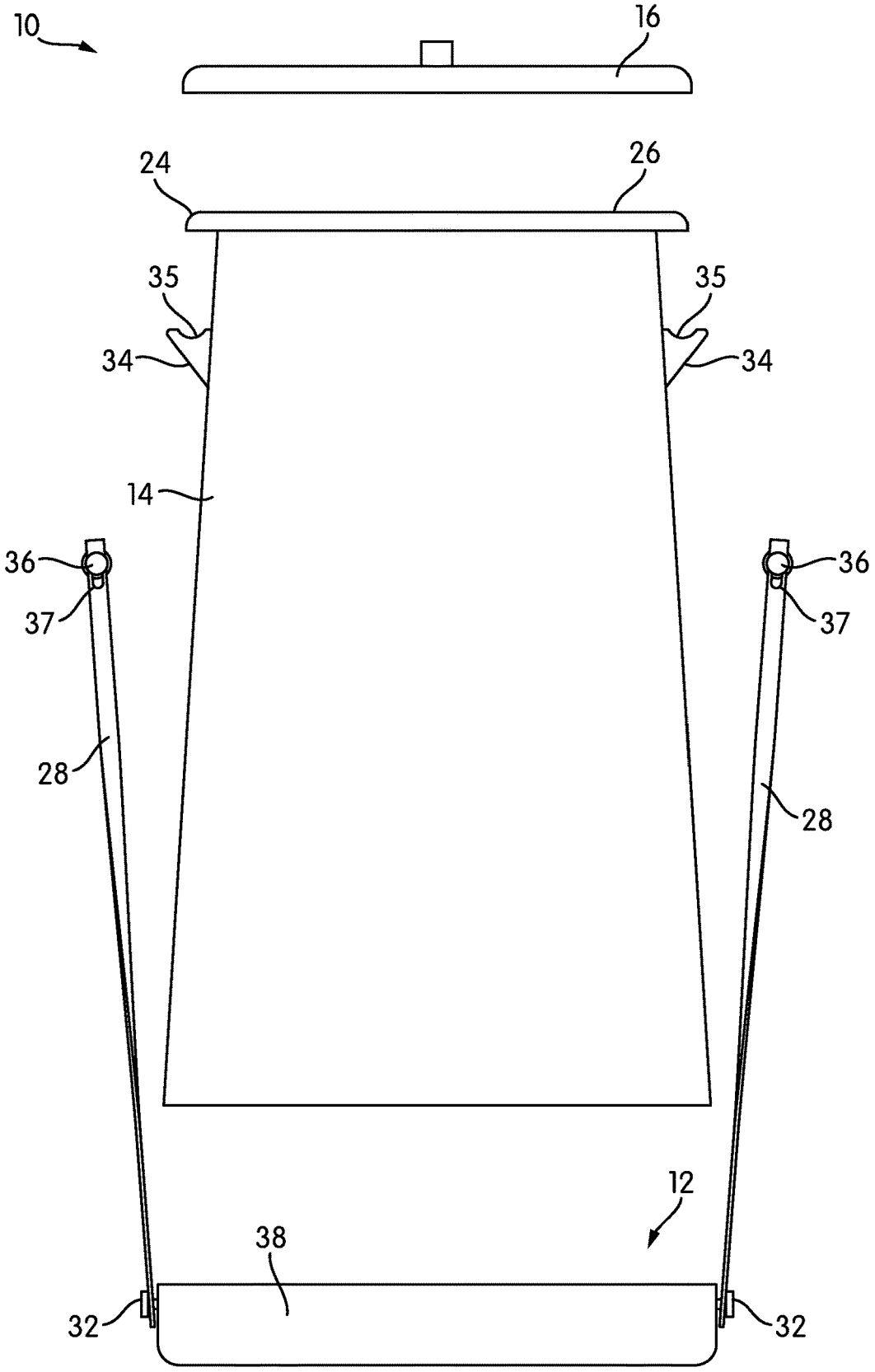
FIG. 3 is an exploded side view of the trash can of FIG. 1.

FIG. 2 is an exploded perspective view and FIG. 3 is an exploded side view of trash can 10, illustrating the separability of base 12 and sidewall 14. Base 12 and sidewall 14 together define a hollow cavity 18 sized and otherwise adapted to hold a trash bag (not shown in FIGS. 2-3). Hollow cavity 18 extends between a top opening 20 of sidewall 14 and a bottom opening 22 of sidewall 14. Top opening 20 is sized to allow a trash bag or other material to be placed within hollow cavity 18. Bottom opening 22 is sized so that sidewall 14 may be lifted around the trash bag or other material resting on base 12 during separation of sidewall 14 from base 12. Hollow cavity 18 may be especially sized for a trash bag of a standard size or type, such as a 13-gallon kitchen garbage bag. Trash cans 10 according to embodiments of the invention may also be made larger, e.g., to accept 40-65 gallon bags, which are more commonly used in commercial settings and to deal with other types of waste, like yard waste. As will be described below in more detail, sidewall 14 is separated from base 12 to remove a trash bag from trash can 10, such as by lifting the sidewall 14 off the base 12 and over the trash bag, to leave the trash bag on base 12.

As shown in FIG. 2, a rim 24 surrounds top opening 20 and protrudes generally outwardly from the top of sidewall 14. Upper surface 26 of the rim 24 is generally horizontal relative to the main extent of the sidewall 14, as can be seen in FIG. 3. Rim 24 serves several purposes. First, rim 24 may be gripped by a user to lift sidewall 14 off base 12 to remove a trash bag from the trash can 10. Second, rim 24 allows the top of a trash bag to be rolled or stretched over it, which helps to keep the bag in place during use. Third, rim 24 provides a resting or mating surface for lid 16. Additionally, particularly if trash can 10 is made of sheet metal, or another material that tends to have sharp edges, the rim 24 may prevent the top of the trash bag from tearing.

As a general matter, trash can 10 may be made of suitable material, e.g., metal or plastic. If made of metal, it may be made using sheet metal with, e.g., welded, brazed, or soldered joints and rolled edges. Metal trash cans 10 may also be cast, machined, or additively manufactured. If made of plastic, trash can 10 may be injection molded, cast, machined, or additively manufactured. More exotic embodiments, e.g., made of wood, are also possible. However, as will be described below, certain elements of trash can 10 may be elastic or resilient.

Figure 4:
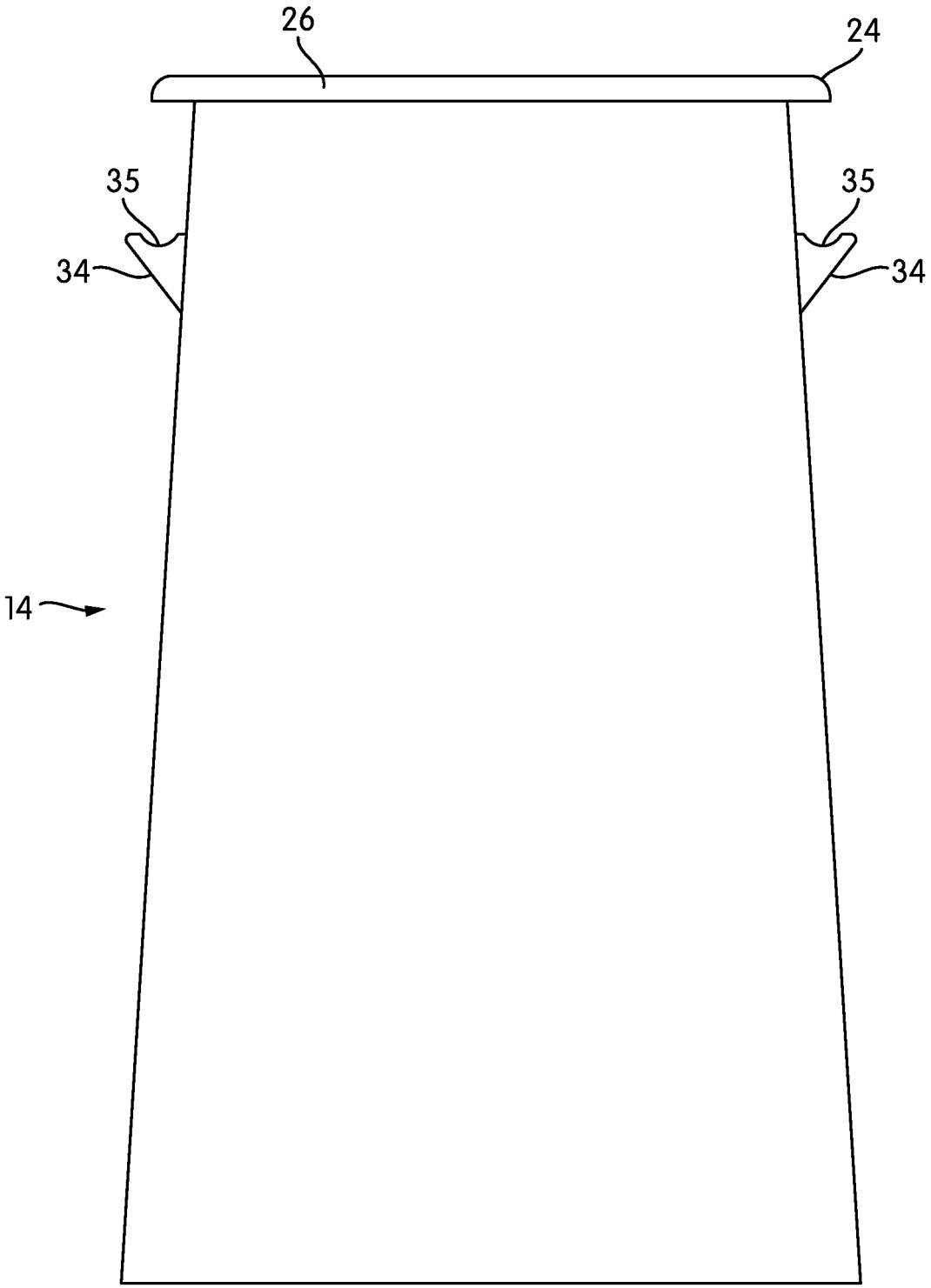
FIG. 4 is a side view of a tapered sidewall according to an embodiment of the invention.

As can be seen in FIGS. 1 and 2, sidewall 14 of the illustrated embodiment has a considerable taper as it extends from lid 16 toward base 12, expanding from rim 24 to base 12. This gives trash can 10 the overall shape of a trapezoidal prism with a wide base. FIG. 4 is a side view of sidewall 14 of trash can 10, illustrating a tapered shape of the sidewall 14 according to an embodiment of the invention. In other embodiments, base 12 may simply have vertical sidewalls with no taper. However, if sidewall 14 is larger close to the base 12, that may facilitate removing a trash bag from trash can 10.

Figure 5:
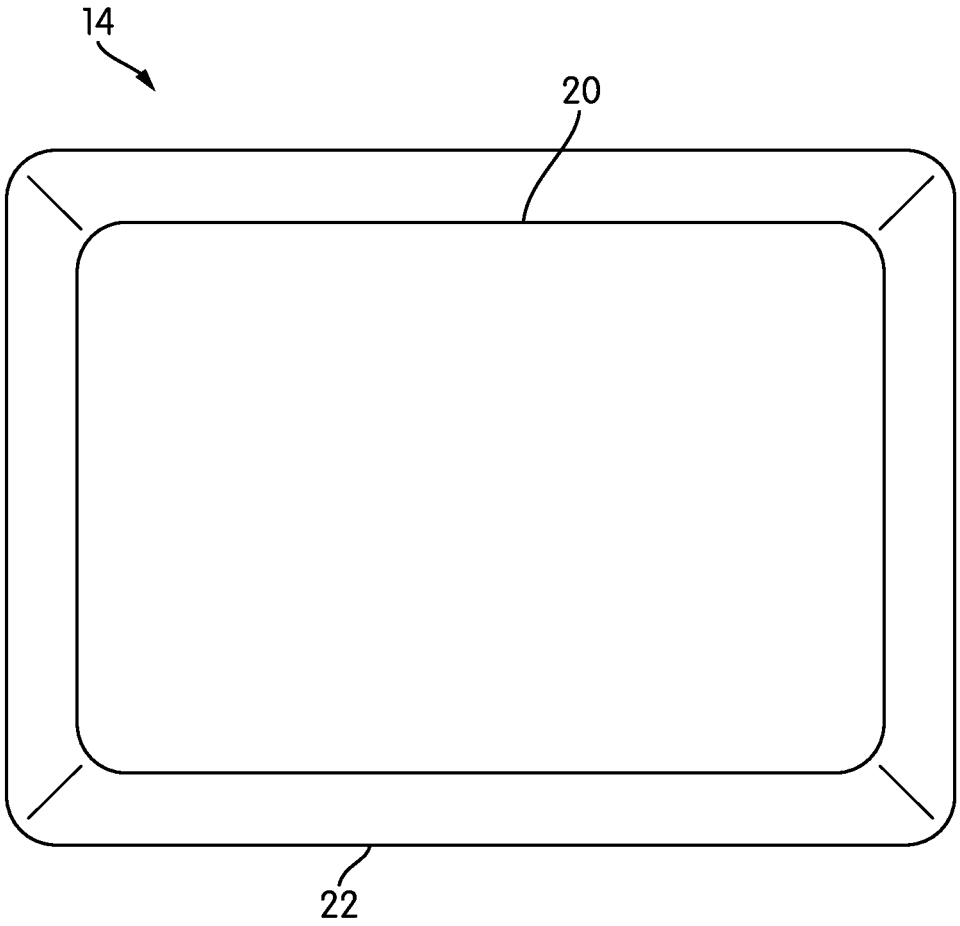
FIG. 5 is a bottom plan view of the tapered sidewall of FIG. 4.

FIG. 5 is a bottom plan view of sidewall 14 of trash can 10, illustrating the sidewall 14 tapering outwardly from the top opening 20 to the bottom opening 22. In the illustrated embodiment, bottom opening 22 is larger than top opening 20 due to the tapered shape of sidewall 14. Providing the tapered shape to sidewall 14 increases the overall volume of the trash can and allows more material to be placed within trash can 10 than a non-tapered trash can having a similarly sized top opening. Generally speaking, gradual changes in the dimensions of sidewall 14 are preferred to steps or constrictions.

As FIG. 5 illustrates, sidewall 14 defines its bottom opening 22 without a constriction in the width of the trash can near its base. Put another way, sidewall 14 lacks a rim or lip around bottom opening 22 that extends inwardly from the sidewall 14, unlike other separable trash cans that have an inwardly extending rim or lip at the bottom, such as the trash can described in U.S. Pat. No. 9,815,622 to Dafoe. The lack of a constriction at or near bottom opening 22 may facilitate removal of sidewall 14 around a bag or other materials within hollow cavity 18 during separation of sidewall 14 from base 12.

As shown in FIG. 1, in normal use of trash can 10, when it is set to hold a trash bag and to receive waste in that bag, a number of straps 28 connect sidewall 14 to base 12. Specifically, pairs of straps 28 are provided on two opposite sides of trash can 10. A base end of each strap 28 is connected to base 12 by a button 32, an outward projection from base 12 having a lip or step that inhibits detachment of the strap 28 from base 12. Notably, the straps 28 connect to the sides of base 12; they do not extend under the base 12.

In the illustrated embodiment, a handle 30 is provided between upper ends of two straps 28, although other numbers of straps 28 may be used in other embodiments. Each of two opposite sides of sidewall 14 includes a holder 34 configured to engage handle 30. Each holder 34 is positioned at a vertical height along sidewall 34 that is commensurate with the length of straps 28. Because all of straps 28 are the same length, each holder 34 is at the same vertical height along sidewall 14. As can be seen in FIGS. 1-3, holder 34 has a recess 35 that receives handle 30 so that the straps 28 secure sidewall 14 to base 12, as discussed in further detail below.

In the illustrated embodiment, straps 28 are separate components connected by handle 30. In other embodiments, the straps 28 and the handle 30 could be formed integrally as one piece. In one embodiment, straps 28 are formed of an elastic cord or elastic rubber material, and tension created by the elasticity of the straps 28 holds sidewall 14 to base 12. Straps 28 may comprise other suitable materials. For example, straps 28 may include metallic material, e.g., steel wire, or plastic material, e.g., vinyl.

As can be seen in FIGS. 1-3, each handle 30 is connected to straps 28 at ends of the handle 30. In the illustrated embodiment, handle 30 includes ears 36, or outward projections at opposing ends of the handle 30, for reversible connection with straps 28. Each ear 36 is configured to cooperate with an opening 37 at the upper end of a strap 28 to connect the strap 28 to the handle 30. As shown in FIG. 2, ear 36 has a narrower part and a wider part. The opening 37 of a strap 28 is seated along the narrower part of the ear 36 when the strap 28 is connected to handle 30. The wider part of the ear 36 serves as a lip or step that inhibits detachment of the strap 28 from the handle 30. In other embodiments, ear 36 may take on other configurations. For example, ear 36 may be configured as a protrusion configured to engage strap 28 in the same manner as a locking hasp. As another example, ear 36 may be a buckle holding strap 28 to the handle 30.

Handle 30 serves several purposes. First, handle 30 cooperates with holder 34 on sidewall 14 so that straps 28 secure base 12 to sidewall 14. As can be seen in FIGS. 1-4, holder 34 is a ledge or rest projecting outwardly from sidewall 14 with a recess 35 that is particularly shaped for the handle 30.

Recess 35 has a concave curve to match the curvature of handle 30. However, holder 34 and recess 35 may take on different configurations in other embodiments. With handle 30 held in recess 35, as shown in FIG. 1, the straps 28 connected to the handle 30 secure base 12 to sidewall 14.

Second, a user may detach handles 30 from holder 34 and grasp the handles 30 for easy carrying and moving of base 12, as will be described below. FIG. 2 shows handle 30 having a generally cylindrical shape, although handle 30 may have a different shape in other embodiments. In some embodiments, handle 30 may be more ergonomic and shaped for the hand.

Figure 6:
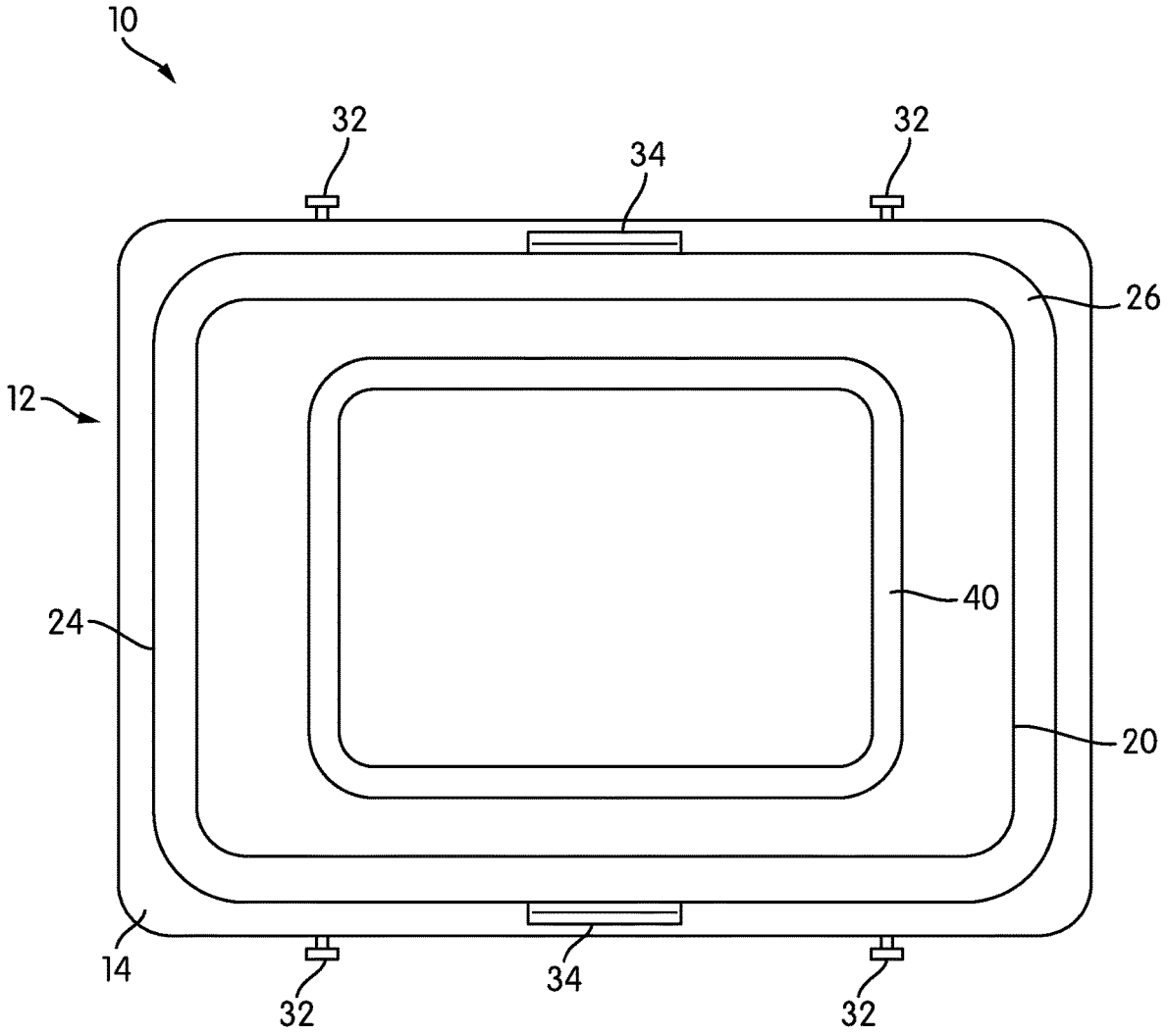
FIG. 6 is a top plan view of the trash can of FIG. 1 without a lid.

FIG. 6 is a top plan view of trash can 10 without a lid. The attachment of straps 28 to buttons 32 on base 12 can be clearly seen in the view of FIG. 6. In the illustrated embodiment, each button 32 includes a narrow part and a wider part configured for reversible connection with strap 28 in a manner similar to the way in which ear 36 connects with a strap 28, as discussed above. In other embodiments, buttons 32 may take on different configurations, such as rivets, hasp projections or buckles, that allow for reversible connection with straps 28. In a further embodiment straps 28 could be formed integrally (i.e., as one piece) with base 12, such as by a molding process.

In the illustrated embodiment, base 12 includes an upwardly-extending perimeter wall 38 from which buttons 32 project outwardly. Perimeter wall 38 itself extends upward at least a few inches, as can best be seen in FIG. 1. Buttons 32 are positioned along wall 38, approximately vertically centered on it, so that straps 28 may be connected to opposite sides of base 12. The locations of buttons 32 along wall 38 shown in the figures are merely exemplary. Buttons 32 may be located at various locations depending upon several factors including, but not limited to, the size or shape of the trash can, expected loads or stresses exerted on base 12 when lifted by handle 30 and straps 28, and convenience for carrying the base 12.

As can be seen in FIGS. 2 and 6, wall 38 extends around an entire perimeter of base 12. Perimeter wall 38 extends upward from the base 12 high enough to prevent liquid or other items from spilling or falling from base 12. In an exemplary embodiment, wall 38 extends to a height of at least about 2 inches to be able to prevent liquid or other material escaping from the base 12. Additionally, perimeter wall 38 may prevent sidewall 14 from sliding off base 12 while straps 28 hold base 12 to sidewall 14. Base 12 may include a rounded edge leading to wall 38, as shown in FIG. 3. While the height of perimeter wall 38 of base 12 is not particularly limited, it is best if perimeter wall 38 is high enough to keep the trash bag on base 12 while it is being carried or moved, but not so high as to pose an obstacle to rolling or otherwise moving the trash bag off of base 12 when the time comes, as will be explained below in more detail.

FIG. 6 also shows that base 12 includes a support rib 40 which may strengthen the base 12 against buckling or failure. In the illustrated embodiment, rib 40 has rectilinear features, although rib 40 could have a different configuration in other embodiments. Buttons 32 may also be aligned with rib 40 to further support and balance base 12 when the base 12 is carried by handles 30.

Figure 7:
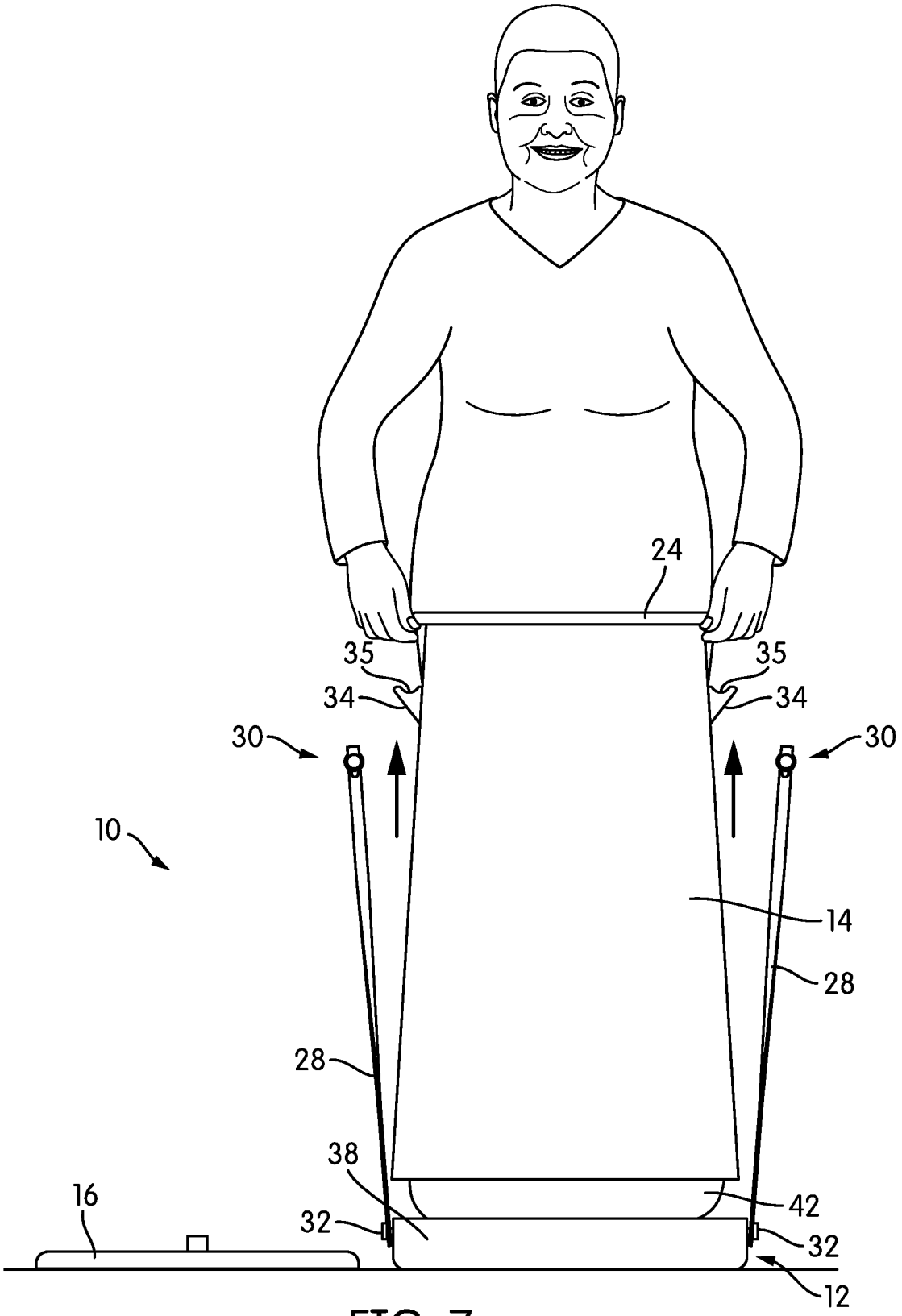
FIGS. 7 and 8 illustrate an exemplary process for emptying a trash can according to an embodiment of the invention.
Figure 8:
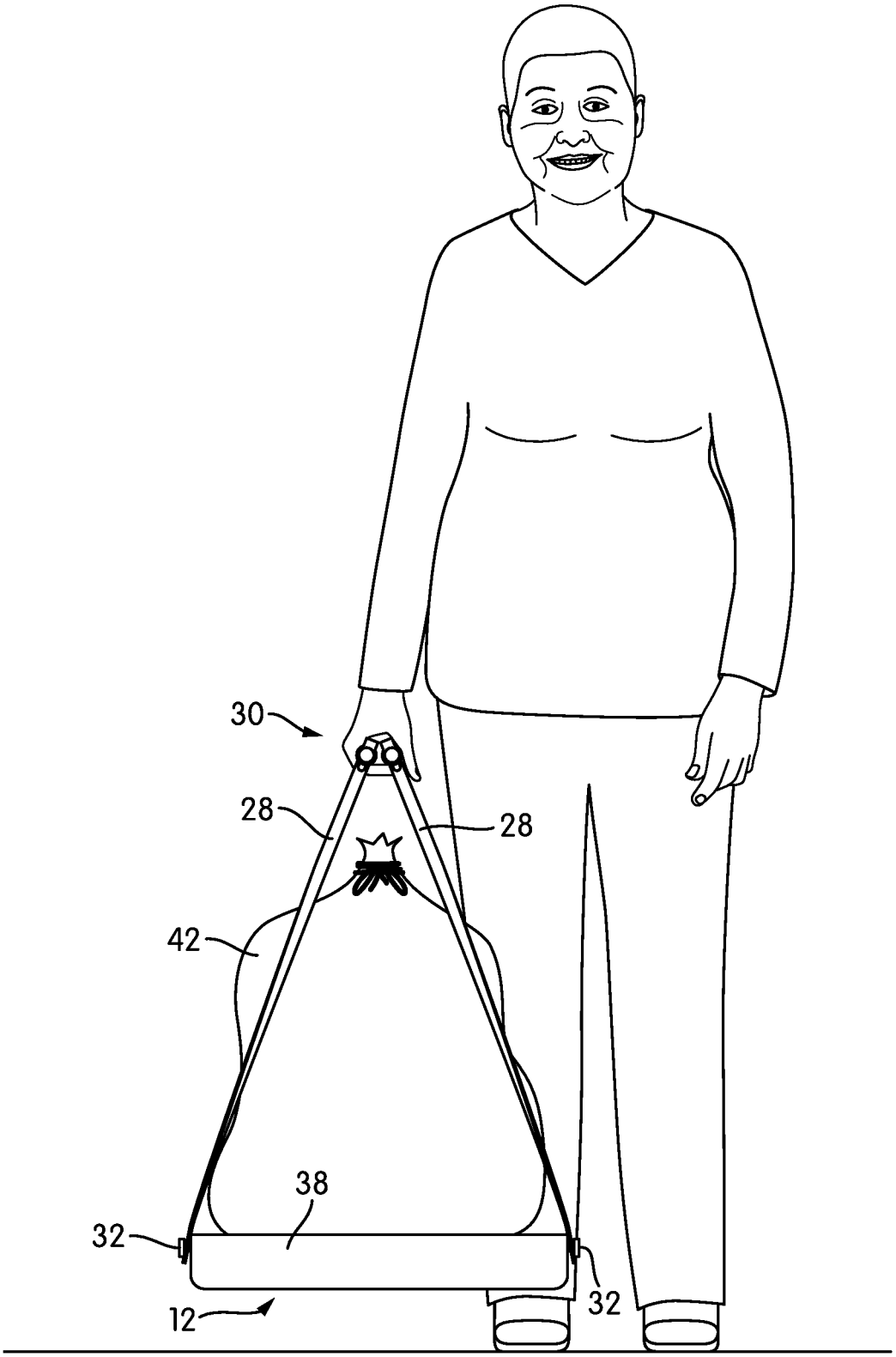

FIGS. 7-8 illustrate an exemplary method of removing a bag 42 from trash can 10. If present, lid 16 is removed from sidewall 14 and set aside. Bag 42 is removed from rim 24 and may be closed. Handles 30 are disengaged from holders 34 so that the sidewall 14 is free for removal from base 12. As sidewall 14 is lifted from base 12, bag 42 exits hollow cavity 18 and remains on base 12. Thus, bag 42 is removed from trash can 10 without having to lift the bag 42 from the trash can 10. The wall 38 of base 12 maintains bag 42 and any liquid or other material that may have leaked from the bag on base 12. A user may easily move base 12 to another location, such as a trash collection site, by grasping the handles 30 and lifting the base 12 by straps 28 which are connected to buttons 32 on the base 12. A user may grip handles 30 separately or may hold handles 30 together, as shown in FIG. 8. As those of skill in the art will realize, base 12 may incorporate other features, like wheels or casters, that make it possible to use straps 28 to drag base 12, rather than carrying it. When desired, bag 42 may be easily removed from base 12 by pushing, rolling, or lifting the bag 42 over wall 38.

Overall, trash can 10 has several advantages. First, as those of skill in the art are aware, trash bags 42 are typically made much larger than the trash cans they are intended to fit. In part, this is to provide extra space to allow the trash bag to be retained in the trash can. The shape of trash can 10 and the manner of emptying it may allow trash bags to be filled more than they would be in a conventional trash can, resulting in more efficient use of bags and less wasted plastic. Additionally, straps 28 and their handles 30 perform a dual function, both securing sidewall 14 and base 12 during use of trash can 10 and allowing base 12 to serve as a carrier for a filled trash bag 42 when it is time to empty trash can 10. The emptying method shown in FIGS. 7 and 8 may be particularly helpful for those who have reduced strength, balance, or coordination, and also reduces the possibility that the bag 42 may tear during the emptying process.

Figure 9:
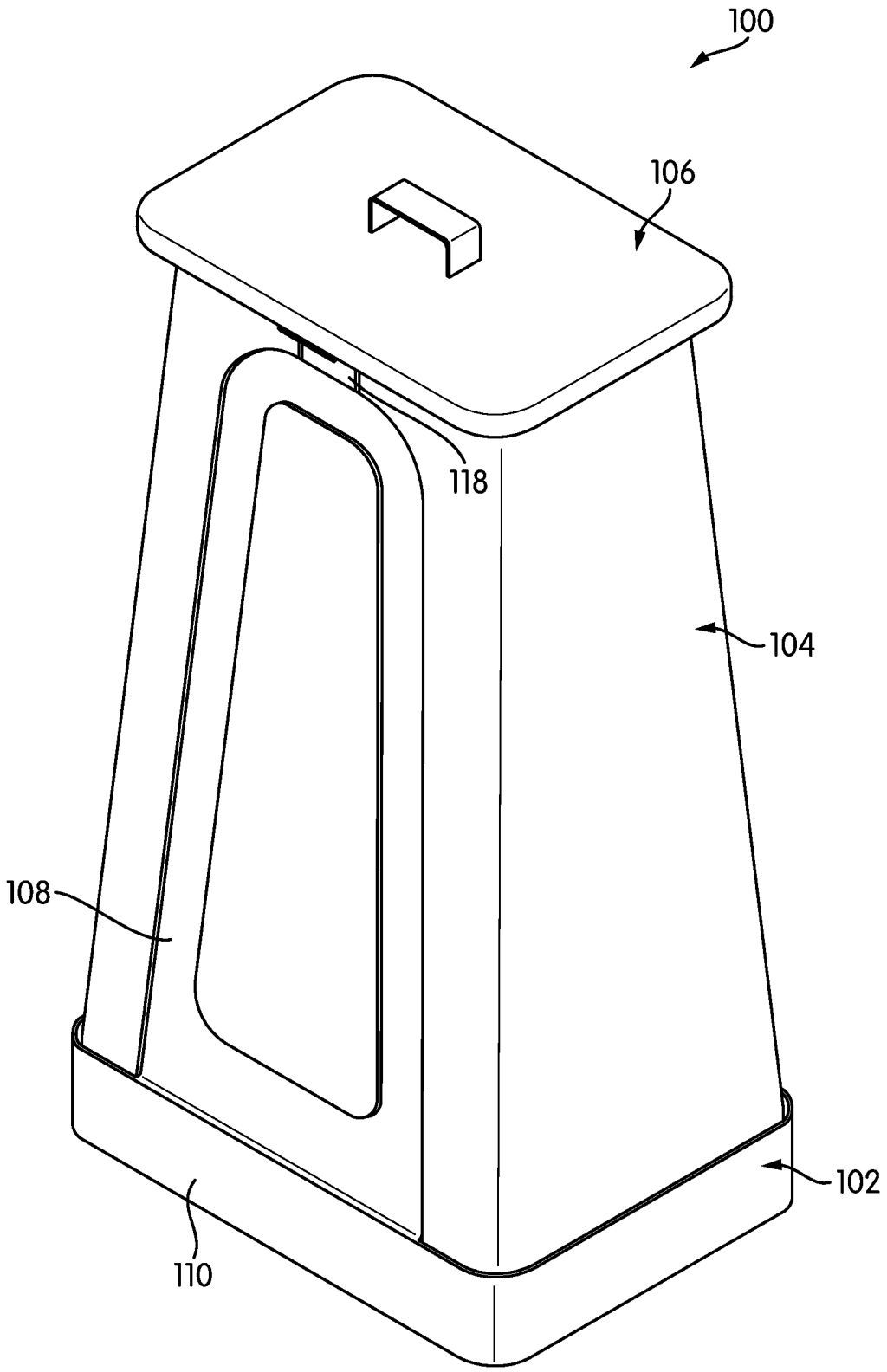
FIG. 9 is a perspective view of a trash can according to another embodiment of the invention.

FIG. 9 is a perspective view of a trash can, generally indicated at 100, according to another embodiment of the invention. Trash can 100 has many of the features described above with respect to trash can 10, including a base 102, a separable sidewall 104, and a simple lid 106. As with the previous embodiment, the sidewall 104 is generally straight-sided and broader near the base 102, giving trash can 100 a trapezoidal overall appearance.

Where the straps 28 of trash can 10 are separable from its base 32, the straps 108 of trash can 100 are not. In trash can 100, the straps 108 are integral with the base 102, with one strap 108 attached to each of the two long sides of the base 102. Specifically, and as will be described below in more detail, the base 102 includes a generally vertically-extending perimeter wall 110, and the straps 108 are integral with or attached to the perimeter wall 100.

In the illustrated embodiment, each strap 108 is a thin and relatively flat piece of material. If trash can 100 or its base 102 is made of plastic, the straps 108 may be injection molded or co-molded in one piece with the base 102. If the two parts 102, 108 are made separately or by separate processes, the straps 108 may be adhered to the base 102, thermally fused, ultrasonically welded, conventionally welded, or attached in some other way, depending on the materials of which the base 102 and straps 108 are made and other such considerations. Functionally, the straps 108 are and serve as upward extensions of the base 102.

Figure 10:
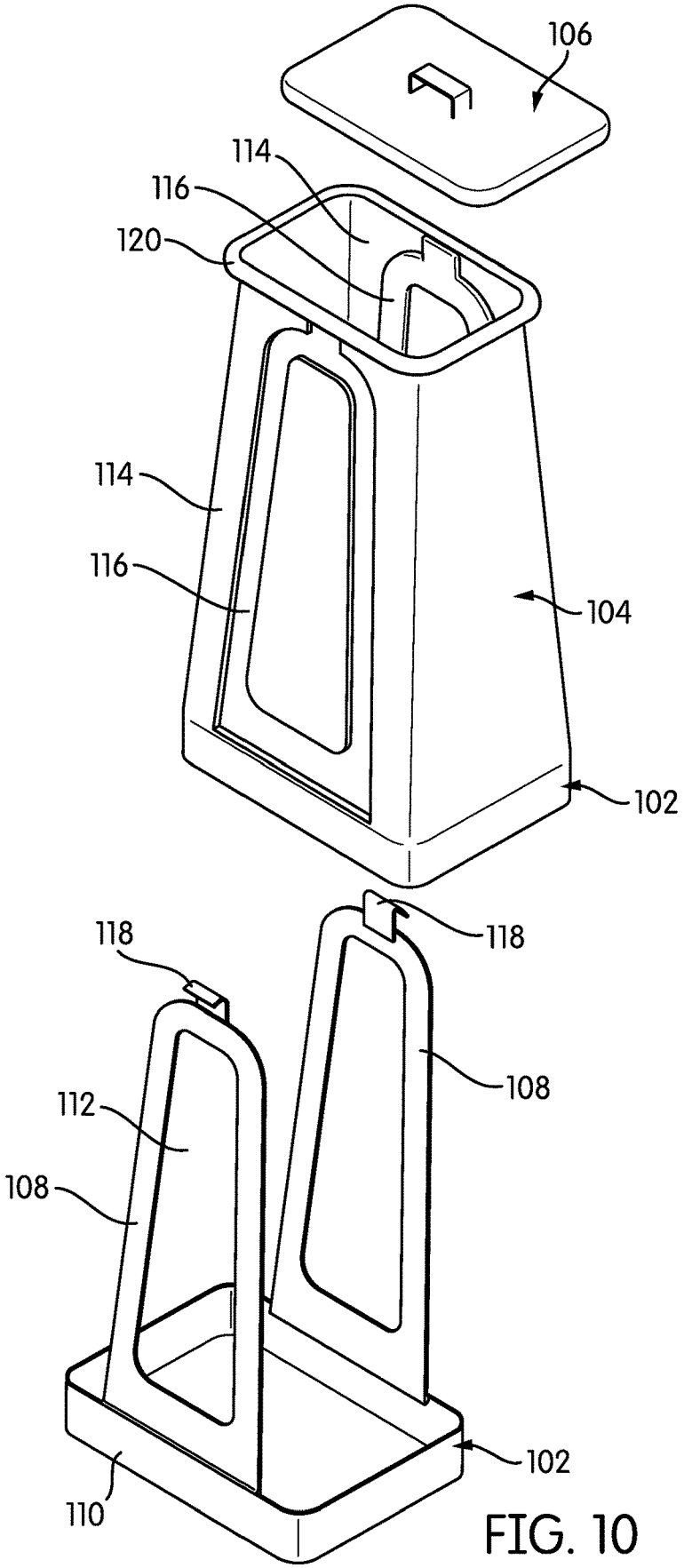
FIG. 10 is an exploded perspective view of the trash can of FIG. 9.

FIG. 10 is an exploded perspective view of trash can 100. As shown, in addition to being contiguous with, and integral to, the base 102, each strap 108 in this embodiment is a single structure with an outer rounded trapezoidal shape and an inner cut out 112, also trapezoidal in this embodiment, that leaves an inner rounded corners and straps 108 that are thicker toward the base 102 and thinner farther from the base 102.

As is apparent in FIGS. 9 and 10, on its broad sides 114, the sidewall 104 has recesses 116. Each recess 116 is the negative shape of a strap 108 and is positioned in the side 114 of the sidewall 104 in a position such that, when the base 102 and sidewall 104 are engaged, the strap 108 can be pressed into the recess 116. The recesses 116 are just larger than the straps 108. With the straps 108 pressed into the recess 116, the straps 108 may be flush with the outer surface of the sidewall 104 or just higher than the outer surface of the sidewall 104. In some embodiments, the recesses 116 may be used to secure the straps 108, e.g., with inwardly-extending flanges or tabs that the straps 108 can be pressed under.

At the top of each strap 108, centered and extending approximately one-third of the total width of the strap, is a tab 118. The tab 118 is fixed to the strap 108 and has a hooked configuration, extending outwardly and down from the top of the strap 108. When the straps 108 rest in their respective recesses 116, the tabs 118 are held in place under the downwardly-curved upper lip 120 of the sidewall 104. The tabs 118 provide a mechanism by which the user can pull outwardly to remove the straps 108 from their recesses 116. The tabs 118 may also serve as handles for carrying the separated base, or as a point of connection to attach a handle.

Figure 11:
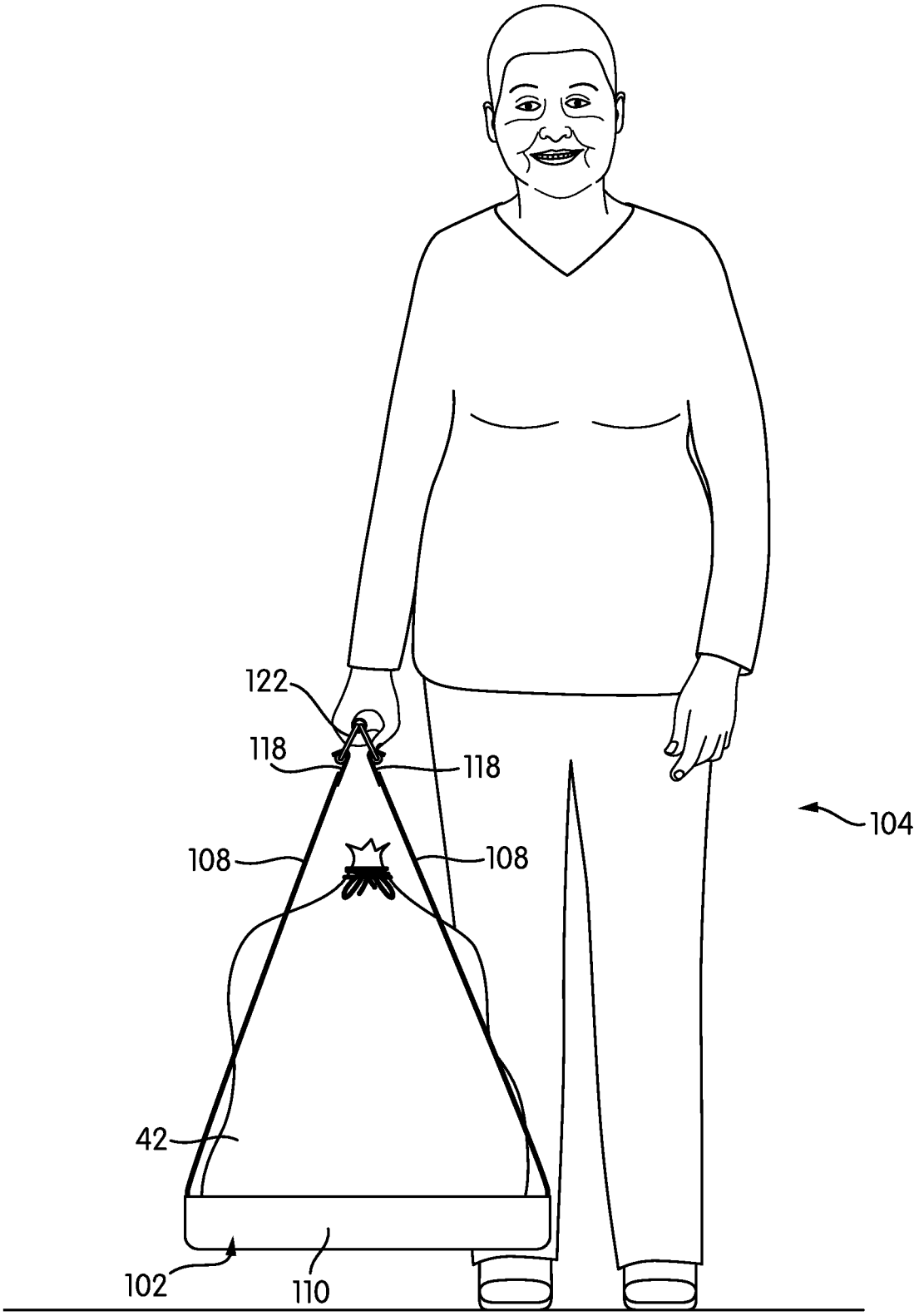
FIG. 11 illustrates the base of the trash can of FIG. 9 used to carry a garbage bag after removal of the sidewall.

FIG. 11 is an elevational view that shows the base 102 in use carrying a trash bag 42 after separation of the sidewall. As was the case with the embodiment described above, the sides of the base 102 rise up to form a perimeter wall 110, which may help to contain any spills from the trash bag 42. In the view of FIG. 11, the person is not carrying the base 102 by the tabs 118; rather, the tabs 118 are used as connection points to attach a simple temporary carrying handle 122. However, in other embodiments, the tabs 118 or the tops of the straps 108 themselves could be used as pick-up points for carrying.

Thus, trash can 100 preserves many of the features described above with respect to trash can 10. However, the integral straps 108 on the base 102 may be simpler to manufacture and impossible to lose or to misplace in use. The recesses 116 provided in the sidewall 104 may prevent the straps 108 from snagging on anything during use, and may allow trash can 100 to fit in tighter spaces than trash can 10.

As with trash can 10, trash can 100 does not include any constrictions in its dimensions where the sidewall 104 meets with the base 102. Near the base 102, the sidewall 104 may change its angle, extending more vertically to match the extent of the perimeter wall 110, but there is no inward step or inward constriction in its width or depth that might cause problems removing the sidewall 104 from the base 102 while leaving the trash bag 42 in place. Any features of trash can 100 that might come into contact with a trash bag 42, like the reverse sides of the recesses 116, may be rounded in shape or otherwise structured to reduce the possibility of snagging or ripping a trash bag 42.

The materials of which trash can 100 are made may vary considerably from embodiment to embodiment. Although injection molding of plastics has been mentioned here, the base 102, sidewall 104, and lid 106 may be made of a variety of materials, including plastic, metal, wood, and rubber. For example, high-density polyethylene (HDPE) may be a suitable material. The components 102, 104, 106 need not always be made of the same materials. For example, the base 102 and straps 108 could be made of sheet metal and the sidewall 104 of metal or plastic. If a part is made of metal, it may be treated, e.g., by galvanization, to resist the environment and prevent deterioration. If the straps 108 are made of a metal, or of any other material that could conceivably be rough or uncomfortable when carrying the base 102, the straps 108 or portions of them could be coated with a material, like PVC, to improve their gripping and carrying characteristics.

Depending on the materials of which the base 102 and straps 108 are made, trash can 100 may have an additional advantage: straps 108 may have enough rigidity to hold their shape against gravity. This may help a user to pick up the base 102 without having to bend over to pick up straps that have fallen to the floor.

While the invention has been described with respect to certain embodiments, the description is intended to be exemplary, rather than limiting. Modifications and changes may be made within the scope of the invention, which is defined by the appended claims.

What is claimed is:

1. A trash can, comprising:

a base;

a pair of straps integral with and arising from the base; and a sidewall adapted to rest on the base such that the sidewall is separable from the base, the sidewall having a pair of recesses positioned and adapted to accommodate the pair of straps when the sidewall rests on the base, each of the pair of recesses matching one of the pair of straps in shape and being of sufficient depth such that when the base and the sidewall are engaged with the pair of straps in the pair of recesses, each of the pair of straps is flush with a surrounding outer surface of the sidewall;

wherein the base is adapted to be carried by the pair of straps.

2. The trash can according to claim 1, wherein the sidewall further comprises an outwardly extending upper lip on an upper portion thereof.

3. The trash can according to claim 2, further comprising a pair of tabs connected to or integral with upper portions of the pair of straps, the pair of tabs sized and adapted to fit under the upper lip.

4. The trash can according to claim 1, wherein the sidewall is broader near a bottom thereof than near a top thereof.

5. The trash can according to claim 1, wherein the base includes a generally vertically-extending perimeter wall.

6. The trash can according to claim 5, wherein each of the pair of straps is integral with the perimeter wall of the base.

7. A trash can, comprising:

a base;

a first strap and a second strap, the first strap and the second strap arising from opposite sides of the base; and a sidewall adapted to rest on the base such that the sidewall is separable from the base, the sidewall having first and second recesses on opposite sides thereof, the first and second recesses corresponding in position to the first strap and the second strap, matching the first strap and the second strap in shape, and being of sufficient depth such that when the base and the sidewall are engaged with the first strap and the second strap in the first and second recesses, respectively, the first strap and the second strap are flush with surrounding outer surfaces of the sidewall.

8. The trash can according to claim 7, wherein the sidewall further comprises an outwardly extending upper lip on an upper portion thereof.

9. The trash can according to claim 8, further comprising a pair of tabs connected to or integral with upper portions of the first strap and the second strap, the pair of tabs sized and adapted to fit under the upper lip.

10. The trash can of claim 9, wherein engagement of the pair of tabs with the upper lip locks the pair of straps into place, thereby locking the sidewall on the base.

11. The trash can according to claim 7, wherein the sidewall is broader near a bottom thereof than near a top thereof.

12. The trash can according to claim 7, wherein the base includes a generally vertically-extending perimeter wall.

13. The trash can according to claim 12, wherein the first strap and the second strap are integral with the perimeter wall of the base, arising from opposite sides thereof.

* * * * *